US005694928A

United States Patent [19]

Hoftman

[11] Patent Number: 5,694,928

[45] Date of Patent: Dec. 9, 1997

[54] EXTENSION FOR FACE MASK AND ATTACHABLE EXTENSION

[76] Inventor: Moshe Hoftman, Calabasas, Calif.

[21] Appl. No.: 688,186

[22] Filed: Jul. 29, 1996

[51] Int. Cl.[6] ..... A62B 18/08; A62B 7/10

[52] U.S. Cl. ..... 128/206.24; 128/206.19; 128/206.21

[58] Field of Search ..... 128/200.27, 200.28, 128/200.29, 201.12, 201.14, 201.15, 201.17, 201.19, 201.22, 201.23, 201.24, 202.29, 205.25, 205.27, 205.29, 206.11, 206.12, 206.13, 206.14, 206.16, 206.17, 206.19, 206.21, 206.23, 206.24, 206.25, 206.26, 206.27, 206.28, 207.11; 2/9, 48, 49.1, 51, 52

[56] References Cited

U.S. PATENT DOCUMENTS

| | | | |
|---|---|---|---|
| 722,273 | 10/1903 | Braverman | 128/206.21 |
| 3,170,461 | 2/1965 | Watts, Jr. | 128/206.21 |
| 3,878,563 | 4/1975 | Pulju | 2/9 |
| 3,885,558 | 5/1975 | Belkin . | |
| 4,041,203 | 8/1977 | Brock et al. | 428/157 |
| 4,288,877 | 9/1981 | Klepfer | 2/48 |
| 4,589,408 | 5/1986 | Singer . | |
| 4,825,878 | 5/1989 | Kuntz et al. | 2/9 |
| 4,945,574 | 8/1990 | Dagher | 2/9 |
| 4,969,473 | 11/1990 | Bothwell . | |
| 5,253,642 | 10/1993 | Stackhouse et al. | 128/205.29 |
| 5,322,021 | 6/1994 | Brunson . | |
| 5,561,863 | 10/1996 | Carlson, II | 128/206.29 |

*Primary Examiner*—V. Millin
*Assistant Examiner*—Robert N. Wieland

[57] ABSTRACT

The present invention is surgical face mask either integral with or applicable as an extension of a prior art surgical mask. A single flat panel of material has a width greater than the prior art surgical mask, to which securing means are attached to side edges thereby permitting control of the fit of the flat panel of material over the wearer's neck, upper chest, ears and shoulders.

15 Claims, 4 Drawing Sheets

EXTENSION FOR FACE MASK AND ATTACHABLE EXTENSION

BACKGROUND OF THE INVENTION

The present invention relates to a mask for shielding the face, neck, ears and shoulders area from splashed or aerosolized biological fluids. U.S. Pat. No. 4,969,473 describes an air filtration mask for a person to prevent inhalation and deposition of vaporized sodium bicarbonate and debris-laden mists generated by dental work. The wearer of the mask is the dental patient, around whose mouth area an opening in the mask is sealed. A number of panels extend from the mouth area to cover the top of the entire head with transparent openings for the eyes of the patient. A set of adhesive tabs secure the panels around the back of the head.

U.S. Pat. No. 4,589,408 describes a surgical face mask. The mask entirely covers the head of the wearer. A broad slit is made for exposure of the eyes below about the supraorbital arches, down to the upper portion of the nose. The neck of the wearer is exposed between the wearer's shirt and the elastic closure of the surgical face mask encircling the wearer's neck. No provision is made for forming a relatively tight, aerosol-resistant seal between the edges of the broad slit for exposure of the eyes and the skin of the wearer.

U.S. Pat. No. 3,885,558 describes a surgical face mask similar to that of U.S. Pat. No. 4,589,408. The wearer's entire head is covered by a draping sheet of material. The deficiency of inadequate closure between the face mask and mouth of the wearer is somewhat improved by provision of an integral, pleated barrier material section for prevention of sterile field contamination by the breath of the wearer. The draped material from the top of the head comprises a broad opening for the eyes and top portion of the nose. The integral, pleated barrier material comprises strings attached to the four corners of the material, such that tying the strings in the back of the head and lower neck secures a seal around the mouth of the integral, pleated barrier material. It is a disadvantage of the design of U.S. Pat. No. 3,885,558 that the draped material is gathered and held tightly against the head of the wearer by the strings tied around the head. The encircling strings form a barrier to convective heat rising from the shoulders, neck and lower head of the wearer. In long procedures, lack of ventilation in the lower portion of the surgical face mask causes heat build-up to become uncomfortable and distracting. In addition, the masks described above that generally cover the head, although providing some limited measure of protection to the wearer from sprayed or aerosolized biological fluids, inhibit the flow of convective heat from the wearer and not only inhibit the wiping of perspiration from the forehead generally above the supraorbital arch, but also encourages the wearer to push the portion of the mask back, thereby impairing vision and causing distracting annoyance.

U.S. Pat. No. 5,322,061 describes a disposable face mask for a generally trapezoid shaped filtration material held approximately perpendicular to the portion of the face in front of the mouth. The shaped filtration material is distinguished over other masks for the ability to maintain a particulate seal between the face of the wearer and the edges of the shaped filtration material although the strapping securing the mask is attached to the edges of the shaped filtration material in only two places. Inspection of the securing strings for the integral, pleated material of U.S. Pat. No. 3,885,558 indicate a more typical pattern of securing a mask about the mouth of the wearer. An integral piece of otherwise unsecured and draped material is shown in U.S. Pat. No. 5,322,061 hanging from the lower edge of the shaped filtration material. An object of the draping is to provide a barrier to a wearer's beard or skin from contaminating a sterile field from microscopic or macroscopic pieces of hair or skin, such as those which adhere to the wearer's skin and later abrade or drop off into the sterile field, or to protect the wearer's neck from contact with aerosols or body fluids. The draping extends from its securing attachment along the lower edge of the shaped filtration material to directly downward from that lower edge to approximately the base of the front portion of the neck of the wearer.

The above prior art provides face masking inadequate in certain ways. The surgical face masks which cover the crown and generally the cranium to reduce contamination of the surgical field by preventing falling hair and other particles comprise no effective seal between the wearers skin and the edge of the broad slit for the eyes. Thus, during a strenuous or long surgical procedure, the tendency of the wearer to manipulate the upper edge of the broad slit for the eyes for improving peripheral vision, ventilation or wiping of perspiration dramatically reduces the effectiveness of the intended barrier. The draping of the head-covering surgical face masks over the neck and shoulders of the wearer, although providing a barrier to droplets or aerosols of liquid, traps the upwardly rising heat of the wearer's body.

In addition, the prior art discloses a draped material extending directly downward from the bottom edge of a shaped filtration material in U.S. Pat. No. 5,322,061. The protection provided by that draped material is of very limited value. There is no indication of attachment or securing of the draped material other than to the bottom edge of the shaped filtration material. Thus, the draped material will tend to remain in a position parallel to the force of gravity, such that the inclined head of the wearer causes the draped material to fall away from the beard or neck, leaving that area unprotected. A further disadvantage of the draped material is that if the mask is made of disposable and generally lightweight material, the draped material could potentially loft upward in a breeze or be raised by catching an upwardly raised hand or arm at the bottom edge of the draped material. Such lofting or raising would at least temporarily obscure the vision of the wearer, perhaps at a crucial time in a surgical procedure.

For the above reasons, there is a need in the art for a surgical face mask overcoming the problems of more effective, comfortable protection of the wearer and formation of a more effective and comprehensive barrier between the wearer and the sterile field.

SUMMARY OF THE INVENTION

The present invention is a surgical face mask. In a first embodiment, a flat panel of flexible material is made attachable to a prior art surgical mask, wherein the prior art surgical mask is generally in the shape of and with string attachments and edging reinforcement similar to the integral, pleated material portion of the face mask of U.S. Pat. No. 3,885,558 or its equivalent. The flat panel of material preferably comprises an upper edge section with an adhesive portion. The adhesive portion is applied to the lower outside edge of a prior art surgical mask after the wearer has attached the mask to the wearer's face, usually by tying string extensions of the four corners of the prior art surgical mask. The flat panel of material below the upper edge section is preferably wider than the lateral width of the prior art surgical mask when it is spread out on a flat surface. At each of the two edges of the flat panel where the upper section becomes a wider lower section, or in a transition thereto, it is preferable to have attached or made integral with those edges of the flat panel first securing means, such as strings or extensions of the flat panel material. The two strings or extensions are adapted to be tied or fastened in back of the wearer's head when the adhesive portion is attached to the prior art surgical mask.

It is a particular advantage of the present embodiment of the present invention that when a wearer's first securing means are drawn toward the back of the wearer's head or neck, an upper portion of the lower section of the flat panel is drawn with widely variable degrees of pressure or closeness toward the neck and upper chest and shoulders of the wearer. The uncontrollable flapping of a draped material shown in U.S. Pat. No. 5,322,061 are almost entirely eliminated. In addition, the width of the lower section is preferably wider than the spread-out width of the prior art surgical mask but also preferably not so wide that an undue amount of excess material is gathered at the wearer's back when the first securing means are tied. More preferably, when the first securing means are tied in back of the wearer's neck or head, a gap of a few inches between the side edges of the lower section is maintained to permit ventilation of the wearer's body heat. The accumulation of body heat that makes the head-covering masks objectionable and annoying is thus avoided while obtaining full protection of the neck, upper chest, shoulders and portions of the upper back from splashed or aerosolized liquids or pieces of solids which have become airborne through surgical procedures.

In a second embodiment of the present invention, the prior art surgical mask is made integral with a flat panel of material similar in form and function to that of the above embodiment. In contrast to the above embodiment, a part of the upper section that retained the adhesive portion is removed to accommodate stitching, gluing or otherwise attaching of a new top edge of the upper section to the bottom edge of the prior art surgical mask. As is the case with the above embodiment, it is preferable to maintain an identifiable distance between the new top edge (which would have been the bottom edge of the adhesive portion in the above embodiment) and an imaginary line formed between the points of effective attachment or integration of the first securing means to the edge of the flat panel of material. The provision of this distance ensures that a variable control is maintained for the wearer over the closeness or pressure of the inside (next to the wearer) of the flat panel of material on the front portion of the neck, upper chest and shoulder.

In this second embodiment, it is also preferable that a portion of the flat panel of material extend upward from the top edges of the lower section. It will be seen that the lower section, since it wider than the upper section, has a top edge generally in a direction parallel to the top edge of the upper section. The top edge the lower section is extended upward such that a newly formed inside edge is formed and adapted to be stitched, glued or otherwise attached to the side edges of the prior art surgical mask. Generally in the area of the top of each of two newly formed outside edges, second securing means are attached or made integral with the flat panel of material. Strings or extensions of the flat panel of material are preferable second securing means. Such strings or extensions may be made part of or may alone provide the function of the upper securing strings of the prior art surgical mask. The second securing means are intended to be drawn to the back of the wearer's head and generally secure over the area of the ear (such as over the temporal and parietal bones of the skull) the upward extension part of the flat panel of material.

As an additional improvement of the first embodiment, the top edge of the upper section is preferably curved concave to the flat panel of material, thereby easily accommodating application of the adhesive portion, which is in turn also curved to adapt to the concavity of the top edge of the upper section.

DETAILED DESCRIPTION OF THE INVENTION

The present invention will now be discussed with reference to FIGS. 1, 2, 3, 4 and 5. As identified above, the present invention uses a flat panel of material. That term is not restricted to strictly flat material, since the objects of the invention may be accomplished with textured, patterned, pleated or otherwise non-flat flexible material. Neither is the present invention limited to having a single, unitary panel of material. The flat panel may be economically divided into various pieces adhesively or otherwise attachable to accomplish protection of the wearer and shielding a sterile field from contamination by the wearer and protection of the wearer from various particulates and aerosolized liquids. The flat panel of material is generally flexible in the upper section and upper portion of the lower section such that the first securing means may draw toward the neck, chest and shoulders of the wearer the flat panel of material.

First Embodiment—Attachable Face Mask Extension

Figure 1:
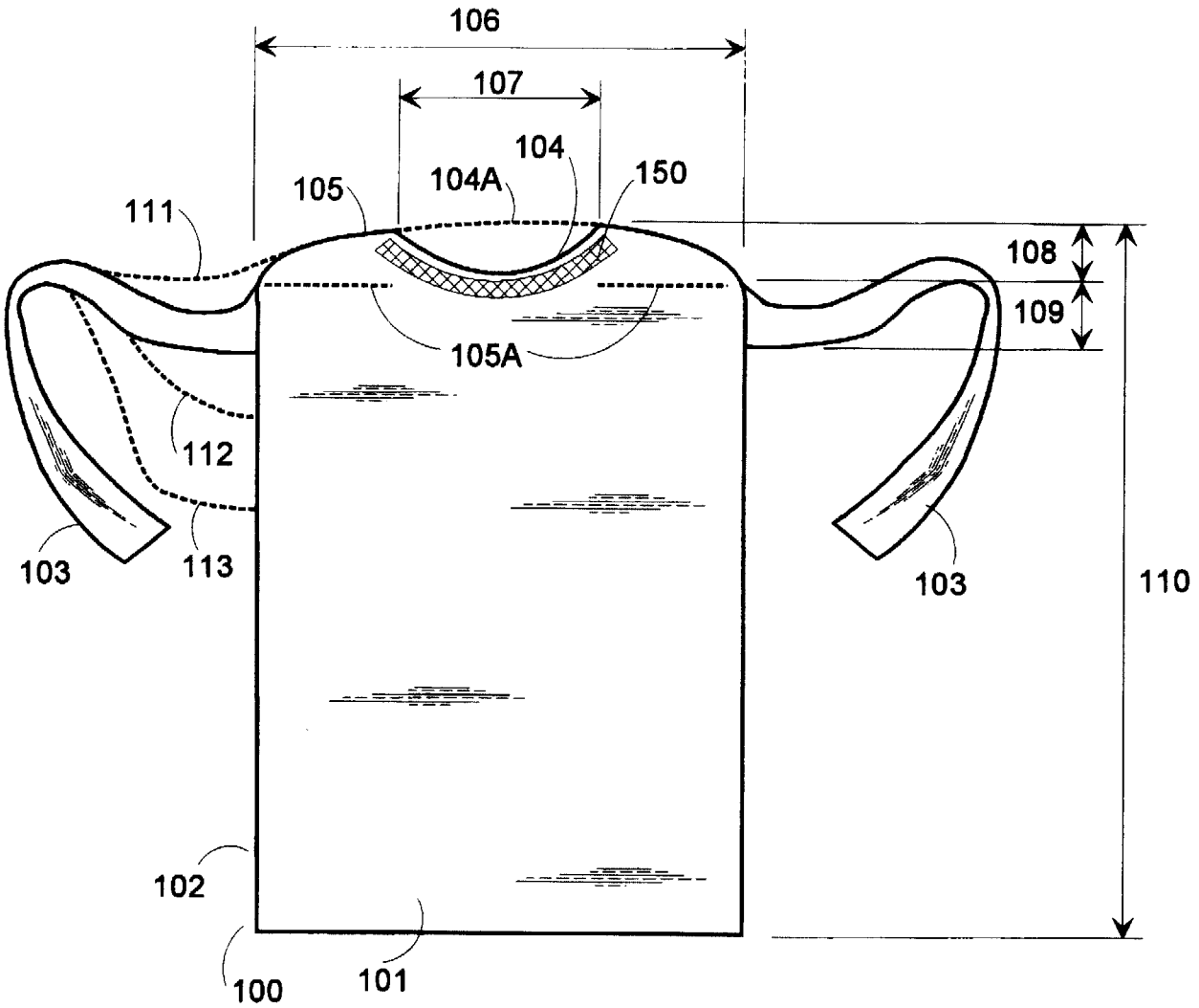
FIG. 1 shows the first embodiment of the present invention. The flat panel of material is shown generally as seen by a wearer just before applying the adhesive portion to the lower edge of a prior art surgical mask. The prior art surgical mask is preferably already secured about the head and/or neck of the wearer.

The first embodiment is generally shown in FIG. 1. Mask extension means 100 preferably comprise a single piece of flexible material with a wearer's side 101 and an outer side 102. The flexible material is preferably a natural or synthetic fibrous material whose outer side 102 is surfaced with water resistant polymer, such as high molecular weight polyolefins which enhance tear strength of a relatively weaker fibrous material. An overall height 110 of mask extension means 100 is divided into an upper section with upper section effective width 107 and upper section effective height 108. The lower section has (1) a lower section effective height defined as the difference between overall height 110 and upper section effective height 108 and (2) a lower section effective width 106. It will be understood that upper section effective width 107 need only be as wide as or somewhat less than the width of a bottom portion of a face mask to which the adhesive means 150 will be applied, such that supportive connection is made with the upper section. Upper section effective top edge 104 (or alternatively 104A) may less preferably have lateral ends which terminate in sharp corners, wherein effective side edges for the upper section are formed approximately perpendicular to lower section effective top edge 105A. These effective side and top edges are less preferable than providing an upper section transition top edge 105 which extends from the ends of upper section effective top edge 104 or 104A to the intersection of lower section effective top edge 105A and the lower section effective width 106.

The use of the term "effective" with respect to the boundaries of the flexible material indicates that further lateral, diagonal or vertical extensions of the flexible material may be made beyond the boundaries modified with the term. However, to effect the objects of the present invention, "effective" boundaries are minimum extensions of flexible material from a place of supportive connection on a face mask to those boundaries. Limited objects of the present invention are achieved when upper section effective width 104 or 104A is about equal to that of lower section effective width 106, although upon application to the wearer, relatively little protection for the shoulders may be obtained.

It is seen in FIG. 1 that adhesive means 150 may partially extend into an upper portion of the lower section, which upper portion has a lower section upper portion effective height 109, defined at its lower edge by the lowest point of effective lateral attachment of first securing means 103. Such downward intrusion of the lower edge of adhesion means 150 in either a curved or substantially laterally straight shape into the lower section upper portion may be done and still accomplish the objects of the present invention. The lowest point of the downward curve of upper section top edge 104 shall not extend to lower section effective top edge 105A.

First securing means 103 are preferably and most economically extensions of the flexible material but may also comprise narrow or wide string, belt or other means with which preferably attach to the area of the intersection of lower section effective top edge 105A and the lower section effective width 106. First securing means 103 are shown as relatively broad extensions of the flexible material so that the flexible material may be made of rather thin and inexpensive material while still providing sufficient tear strength so that when first securing means 103 are tied in back of a wearer's head, those means will not break. Width enhancements 111, 112 and 113 for first securing means 103 are optionally added to provide additional protection for the wearer's head, neck, ears and shoulders about below the level of the ear. Attachment of separately formed piece or extension of flexible material to form first securing means 103 to the lower section is made to permit a wearer to draw first securing means behind their head or neck loosely or tightly depending on fit desired for the circumstances of protection required.

This first embodiment creates for the purchaser of standard face masks a method of optionally having available a face mask providing protection of the neck, chest, ears and shoulders without having to purchase an entire inventory of those higher priced face masks. The wearer can choose not whether to have mask extension means, but can also choose any desired length of extension from the effective boundaries described above to a full wraparound gown, wherein the flexible material could be extended below the upper portion of the lower section to become a lightweight, open-backed gown with long sleeves to provide full upper body, ventilated protection.

Figure 3:
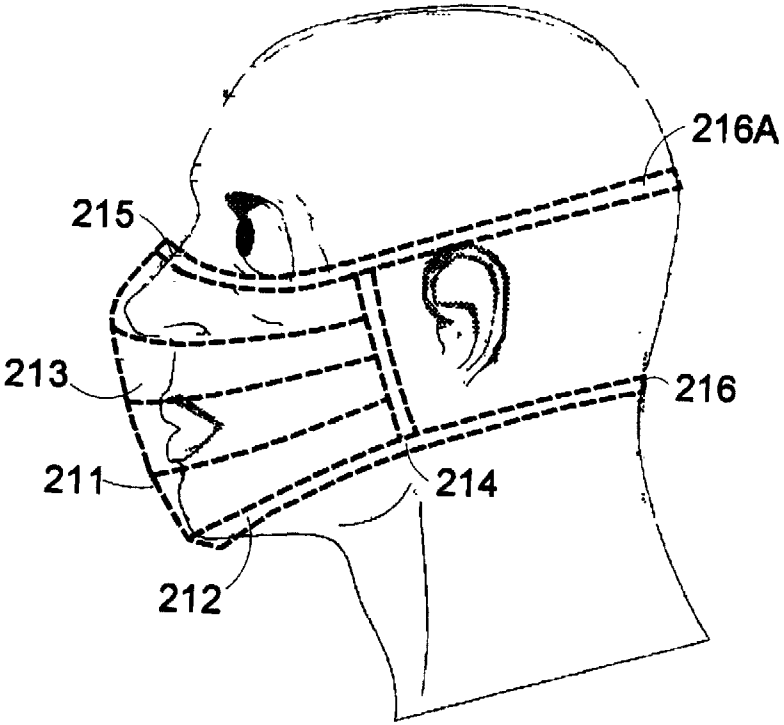
FIG. 3 shows a side view of a wearer of a prior art surgical mask. The prior art surgical mask portion in FIGS. 3, 4, and 5 is shown in broken lines as a transparent piece to enhance the understanding of the application of the flat panel of material to the prior art surgical mask.

In the application of the mask extension means 100 to a surgical or other face mask, the curved top edge 104 and similarly curved adhesive means 150 located just below that edge are adapted to more easily wrap around the surgical mask already held in effective position on the face of the wearer. It is an important object of this embodiment to apply with relative ease the mask extension means 100 to a surgical mask already secured on the wearer. Alternatively, the wearer may have mask extension means pre-applied to a face mask before donning the combination mask and extension just before gowning for surgery. Just such a mask is shown in FIG. 3 as surgical mask 211. It will be appreciated that the mask extension means 100 with a straight top edge 104A supplied with a similarly shaped adhesive means (not shown) located just below the upper section effective top edge 104A will not as effectively achieve the ease of application described herein for the mask extension means 100 with a curved top edge. It is another embodiment of the present invention to adapt the adhesion means 150 to an outer side 102 of an upper portion or the upper section for supportive attachment to a lower portion wearer's side of a surgical or other face mask.

Figure 5:
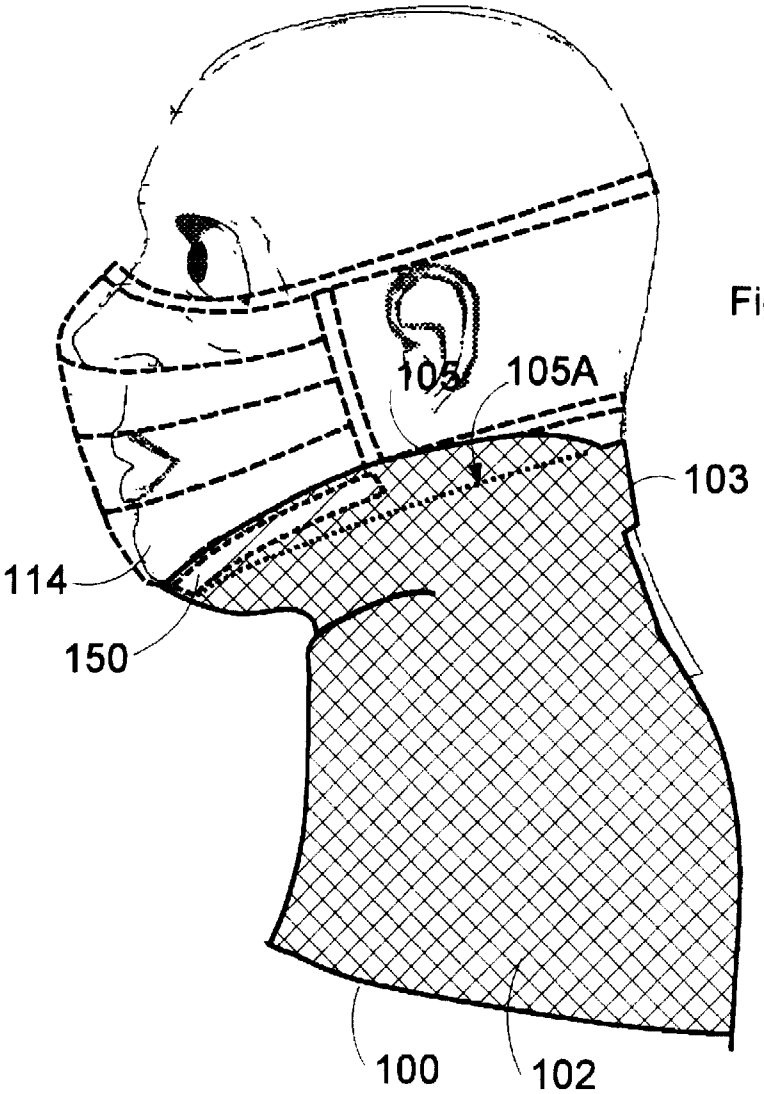
FIG. 5 shows a side view of a wearer of the first embodiment of the present invention.

FIG. 5 shows on a wearer the first embodiment mask extension means 100 adhesively supported by adhesion means 150 on a surgical mask with pleated barrier, bacterial filtration material and edge support means to which are attached securing means (strings). First securing means 103 are drawn quite tightly to behind the wearer's neck, causing the outer side 102 to define the neck, upper chest and shoulders of the wearer. It will be seen in FIG. 5 that the side edges of the lower section do not meet, thereby leaving a gap for ventilation of the wearer's body heat. At the time of application of the first embodiment to a face mask already in place, the wearer thus has control over the degree of looseness of fit by drawing more less of first securing means 103 to the back of the head or neck. In order to more fully appreciate the application of the first embodiment to a face mask, the face mask 211 shown applied to a wearer in FIG. 3 will be described. Lower face mask securing means 216 and upper face mask securing means 216A are attached, respectively, at the lower and upper corners of roughly rectangular edge support means 212. Pleated barrier, bacterial filtration material 213 for prevention of sterile field contamination by the breath of the wearer is usually stitched to edge support means 212. Typically, in the nose support area 215 a nose support is secured to the wearer's side of the mask. The nose support reduces the discomfort of sealingly tying securing means 216 and 216A behind the head. The nose support usually comprises a urethane foam-covered piece of metal or plastic, wherein the metal is secured to the nose support area 215 and the urethane foam contacts the bridge of the wearer's nose.

Second Embodiment—Integral Face Mask Extension

The second embodiment will now be discussed with reference to FIG. 2. Several portions of the second embodiment are analogous in form and function to those parts of the first embodiment. In general, the face mask described above in FIG. 3 has integrally attached to its lower portion or bottom and/or side edge support means (preferably by stitching or adhesive means applied at the time or production) some portion of the effective top edges of the upper section of the mask extension means.

Figure 2:
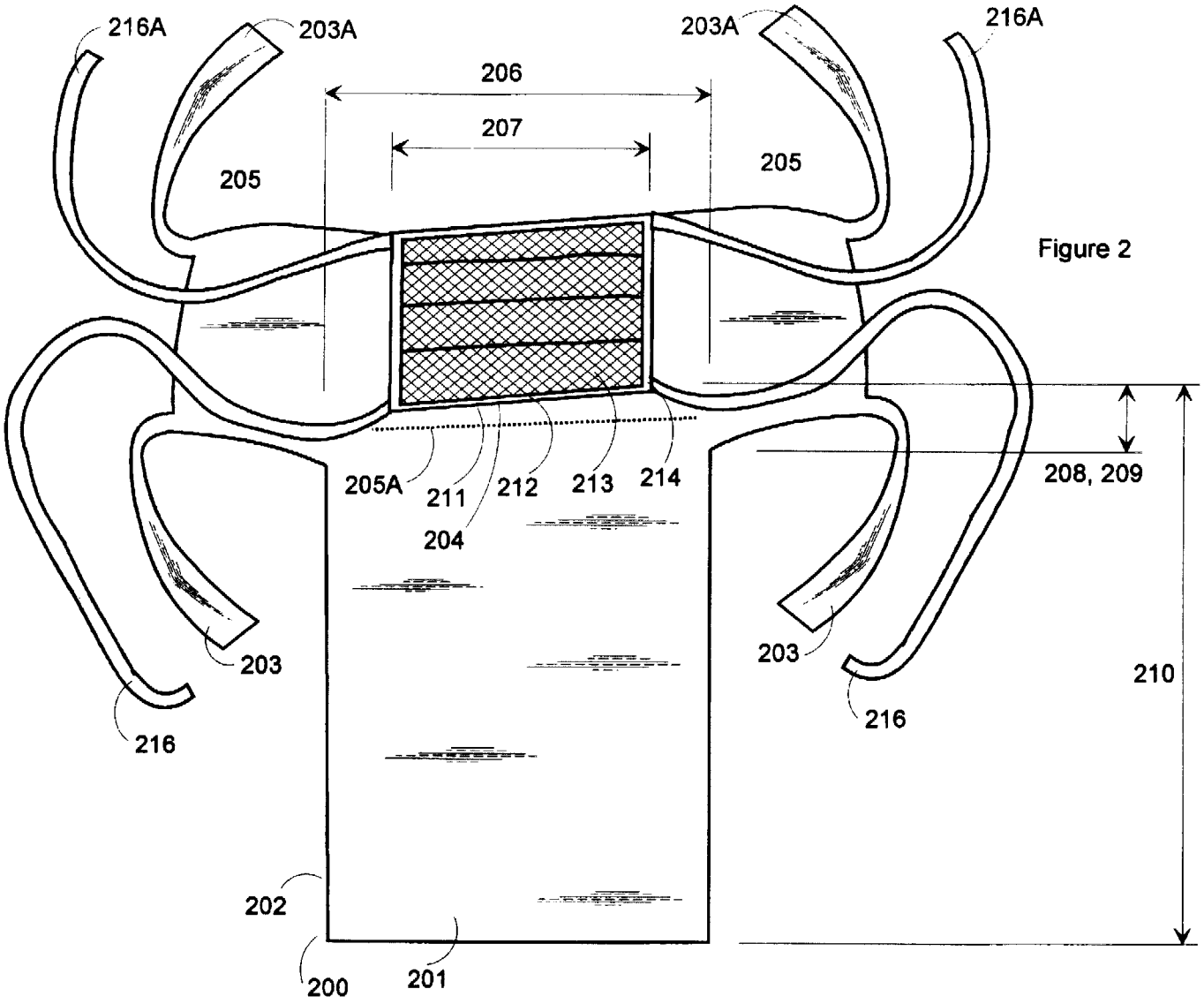
FIG. 2 shows the second embodiment of the present invention. The flat panel of material has removed from it the adhesive portion and extended top edges of a lower section of the flat panel of material. The extended portion further comprises integral second securing means.
Figure 4:
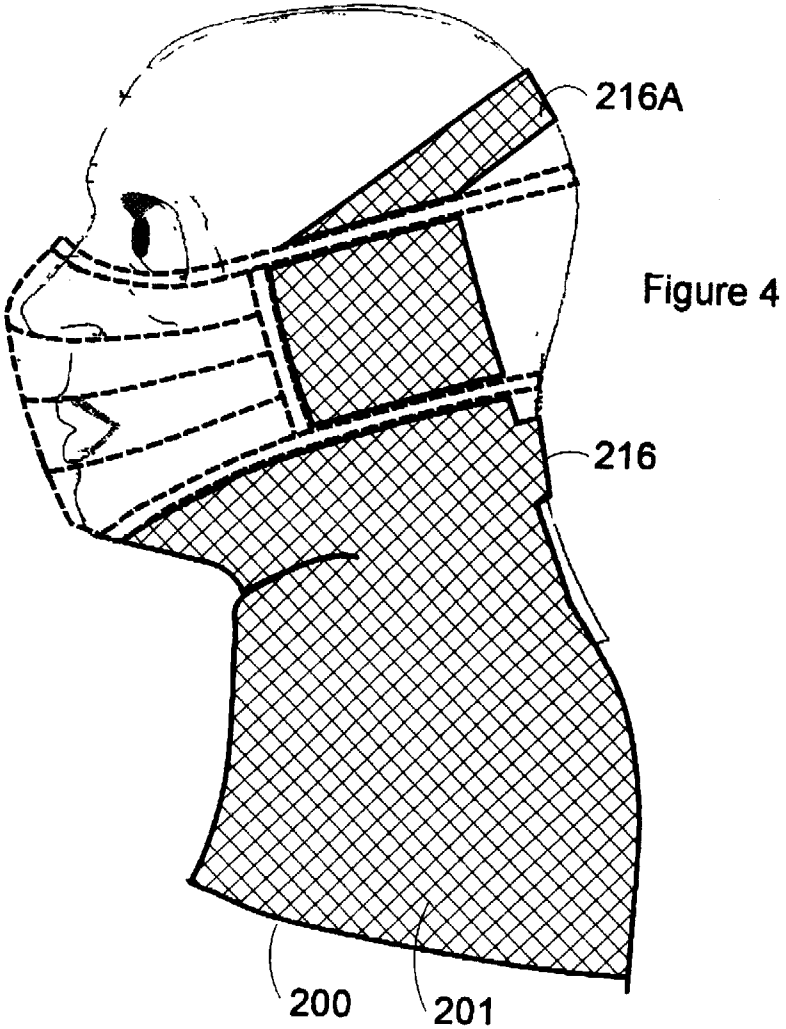
FIG. 4 shows a side view of a wearer of the second embodiment of the present invention.

The aspects of FIGS. 2, 3 and 4 with identical numbering have substantially the same form and function. Thus face mask 211 is seen in FIG. 2 to have been made integral with mask extension means 200 along edge support means 212. As the minimum extension of flexible material from edge support means 212 to effect the objects of the present invention, the effective sides and top edges of the first embodiment are substantially the same as those of the second embodiment. Aspects of FIG. 1 with the numbers 203, 204, 205A, 206, 207 and 210 correspond with respect to naming and effective minimum requirements for extension of flexible material from face mask 211 respectively to those aspect numbers 103, 104, 105A, 106, 107 and 110 in FIG. 1. Upper section effective top edge 204 is adapted in this second embodiment to the shape of the bottom edge of the edge support means 212 instead of conforming to a desired adhesive means form as for the first embodiment. Lengths 208 and 209 are combined in FIG. 2 and are respectively analogous to the separately designated lengths 108 and 109 in FIG. 1.

Mask extension means 200 has an outer side 201 and a wearer's side 202 opposite to it. This second embodiment provides for an upward extension of the transition top edge 105 from the first embodiment of FIG. 1, such that a second transition top edge 205 in FIG. 2 now defines the outer edge of the extension of flexible material and a second securing means 203A. To effectively draw the upward extension of the upper section for this second embodiment alongside the head of the wearer, second securing means are drawn around and secured to the back or top of the wearer's head. Although the general shape of the upward extension of the upper section is, in FIG. 2, roughly quadrilateral, any shape adaptable to the objects of providing an extension of the upper section are contemplated as long as part of the upward extension is secured to at least part of the side edges of face mask 211 and second securing means 203A may be crafted to draw the upward extension about the side of the wearer's head. FIG. 4 shows the covering effect of the upper extension such that the wearer's ears are covered when second securing means 216A are fastened behind the wearer's head.

It will be apparent with the above disclosure of the present invention that the shape of face mask 211 need not be quadrilateral to obtain the benefits of the present invention. An oval-shaped face mask will require adaptation according to the above teaching concerning the shape of the effective top and side edges, but the protection and ease of application of the mask extension means of the present invention may still be relatively easily obtained.

Those design options will sometimes present the designer with considerable and wide ranges from which to choose appropriate modifications for the above examples. For example, it is a further embodiment that either the first or second securing means or both may be removed or allowed to remain untied to obtain some of the benefits of the present invention. It is a further embodiment that the wearer's side of the mask extension means can comprise material similar to that on the wearer's side of the face mask to enhance long term wearability or that the wearer's side of the mask extension means may comprise a layer of high molecular weight polyolefin film to enhance the barrier to perfusion of contaminants from the wearer to the sterile field. However, the objects of the present invention will still be obtained by the skilled person applying such design options in an appropriate manner.

I claim:

1. Face mask extension means for shielding at least a wearer's neck from liquids and airborne debris in combination with a face mask with a lower edge portion adapted to be drawn in contact with or just beneath a wearer's chin comprising:

(a) flexible material comprising an upper and a lower section, wherein an upper portion of the upper section is adapted to be supportively connected to the lower edge portion of a face mask, the lower section comprises side edges, and an upper portion of the lower section is adjacent to the upper section;

(b) a first securing means attached at least to the side edges of the upper portion of the lower section and adapted to draw at least the side edges of the upper portion of the lower section toward a back of a wearer's neck or head;

(c) the upper section having an effective lateral width of at least about the same side edge to side edge lateral width of the face mask; and (d) the lower section having an effective lateral width equal to or greater than the effective lateral width of the upper section.

2. The face mask extension means of claim 1 wherein the adaptation for supportive connection of the upper portion of the upper section comprises adhesion means located on the wearer's side or outer side for supportive attachment of the upper portion of the upper section of the face mask extension means respectively to the outer side or the wearer's side of the lower edge portion of the face mask.

3. The face mask extension means of claim 1 wherein the flexible material comprises a natural or synthetic fibrous material surface with a moisture resistant polyolefin on an outer side, wherein the outer side is opposite to the wearer's side.

4. The face mask extension means of claim 1 wherein the upper portion of the upper section is made integral with the lower edge portion of the face mask.

5. The face mask extension means of claim 4 wherein the upper portion of the upper section further comprises vertical extension of the flexible material adapted to supportively to connect side edge portions of the face mask without covering the outer or wearer's side of the face mask.

6. The face mask extension means of claim 5 wherein the vertical extension of the upper portion of the upper extension further comprises a second securing means which extends from or is attached to the vertical extension and which point of extension or attachment is adapted such that the second securing means can draw the vertical extension protectively about the side of the wearer's head.

7. The face mask extension means of claim 6 wherein the face mask has upper and lower face mask securing means for securing the face mask about the wearer's mouth or nose, such that the face mask securing means are separate from either the first or second securing means.

8. The face mask extension means of claim 7 wherein the lower face mask securing means are connected or made integral with the first securing means and adapted to draw to the back of the wearer's neck or head the side edges of the face mask and the side edges of the upper section with a single set of motions.

9. The face mask extension means of claim 6 wherein the upper face mask securing means are connected or made integral with the second securing means and adapted to draw to the back or top of the wearer's or head the side edges of the face mask and the side edges of the vertical extension with a single set of motions.

10. The face mask extension means of claim 1 wherein the effective lateral width of the lower section is made only wide enough to effect a gap of a few inches or more between the side edges of the lower section vertically along the back of the wearer's neck or back when the first securing means are secured about the wearer's neck or head.

11. The face mask extension means of claim 1 wherein the upper portion of the lower section comprises a lower section effective top edge substantially straight and parallel to the lateral width of the upper and lower sections and located at an effective vertical distance from a top edge of the upper portion of the upper section.

12. The face mask extension means of claim 11 wherein the upper portion of the lower section is vertically extended from the lower section effective top edge to form a transition section with a curved top edge.

13. The face mask extension means of claim 1 wherein the wearer's side comprises a first layer of relatively soft hand wearable fibrous material.

14. The face mask extension means of claim 1 wherein the wearer's side comprises a first layer of high molecular weight polyolefin film adapted to form a barrier between the wearer and a sterile field.

15. A method for applying face mask extension means for shielding at least a wearer's neck from liquids and airborne debris in combination with a face mask with a lower edge portion adapted to be drawn in contact with or just beneath a wearer's chin comprising:

(a) flexible material comprising an upper and a lower section, wherein an upper portion of the upper section is adapted to be supportively connected to the lower edge portion of a face mask, the lower section comprises side edges, and an upper portion of the lower section is adjacent to the upper section;

(b) a first securing means attached at least to the side edges of the upper portion of the upper section and adapted to draw at least the side edges of the upper portion of the lower section toward a back of the wearer's neck or head;

(c) the upper section having an effective lateral width of at least about the same side edge to side edge lateral width of the face mask;

(d) the lower section having an effective lateral width greater than the effective lateral width of the upper section;

(e) the adaptation for supportive connection of the upper portion of the upper section comprises adhesion means located on the wearer's side or outer side for supportive attachment of the upper portion of the upper section of the face mask extension means respectively to the outer side or the wearer's side of the lower edge portion of the face mask; and (f) a wearer wearing the face mask subsequently adhesively attaching the upper portion of the upper section to the lower edge portion of the face mask.

* * * * *